United States Patent [19]

Vasek et al.

[11] 4,071,052

[45] Jan. 31, 1978

[54] ROTARY REED HAVING FACILITIES FOR ADJUSTABLY SEPARATING GROUPS OF LENO WARP THREADS

[75] Inventors: Vitezslav Vasek; Pavel Koblizek; Karel Prazak, all of Usti nad Orlici, Czechoslovakia

[73] Assignee: Vyzkumny ustav bavlnarsky, Usti nad Orlici, Czechoslovakia

[21] Appl. No.: 726,164

[22] Filed: Sept. 24, 1976

[30] Foreign Application Priority Data

Oct. 3, 1975 Czechoslovakia ..... 6720/75

[51] Int. Cl.[2] ..... D03D 47/26; D03D 5/00; D03D 49/68

[52] U.S. Cl. ..... 139/436; 139/54; 139/188 R

[58] Field of Search ..... 139/48, 49, 50, 54, 139/436, 188, 190

[56] References Cited

U.S. PATENT DOCUMENTS

| | | | |
|---|---|---|---|
| 2,399,880 | 5/1946 | Moessinger | 139/54 |
| 3,766,950 | 10/1973 | Vasek et al. | 139/436 |
| 3,833,025 | 9/1974 | Loschilin et al. | 139/436 |
| 3,998,247 | 12/1976 | Kovar | 139/54 |

FOREIGN PATENT DOCUMENTS

| | | | |
|---|---|---|---|
| 2,329,892 | 1/1974 | Germany | 139/436 |
| 2,028,844 | 12/1971 | Germany | 139/54 |

*Primary Examiner*—James Kee Chi

[57] ABSTRACT

An improved arrangement of leno discs on axially opposite sides of the main fabric beat-up discs of a rotary reed is described. Three leno discs are provided in each set, with the channel between the innermost and intermediate ones of the discs in each leno set being established by an adjustable spacer to form the required warp-free zone between spaced bundles of the leno warp threads guided by the leno discs. The innermost disc of each set is identical in construction with the outermost disc, with the intermediate one of the discs differing from the other two only by exhibiting a peripheral warp-confining chamfer which is complementary to that of the other two discs. The chamfer of the intermediate disc is disposed on the reed shaft in axially opposed relation to the chamfer of the innermost disc.

12 Claims, 3 Drawing Figures

ROTARY REED HAVING FACILITIES FOR ADJUSTABLY SEPARATING GROUPS OF LENO WARP THREADS

BACKGROUND OF THE INVENTION

The invention relates to rotary reeds having a plurality of first fabric beat-up discs arranged in axially spaced relation on a central reed shaft, and sets of second leno discs disposed on opposite sides of the fabric discs for guiding leno warp threads. The peripheries of the successive discs along the read axis exhibit angularly offset recesses which cooperate to establish a helical weft-receiving passage, which receive picks of weft in interleaved relation with the guided warp threads and which, during rotation of the read beat-up the inserted weft into a fabric fell.

The fabric selvedges below the respective sets of leno discs on the read shaft are each conventionally strengthened by axially spaced leno weaves. The outermost, or reinforcing, leno weave in the selvedge is spaced by a warp-free zone from the main or fabric selvedge, so that the auxiliary selvedge may be severed therefrom by a weft cutter which is positioned along the warp-free zone, so that ultimately the main leno weave is left to secure the final fabric selvedge.

In these arrangements, warp-confining chamfers are provided in the peripheral edges of at least some of the leno discs in each set to help guide the leno warp threads into the proper channels between the discs.

A disadvantage of known leno disc set arrangements is that the discs are constructed and arranged in a relatively complicated way, e.g., each set includes four discs, three being of different construction. Additionally, in such designs the warp-free zone between the main and reinforcing leno weaves is established by the thickness of one of the intermediate leno discs in the set, so that changes in such warp-free zone must be accomplished by physically substituting another leno disc having a peripheral edge construction similar to that of the first disc but of altered thickness. Additionally, the change of thickness of the intermediate leno disc requires that the spacing between the main fabric disc be correspondingly altered.

SUMMARY OF THE INVENTION

Such disadvantages are overcome by the leno disc arrangements constructed in accordance with the invention for positioning in a rotary reed of the general type indicated above. In an illustrative embodiment, three axially spaced leno discs are provided in each set, with the inner and outer disc of each set being of identical construction. The intermediate disc of the set has a warp-guiding chamfer which is complementary to that of the corresponding chamfers on the inner and outer discs, but is otherwise of identical construction.

The required warp-free zone in the leno arrangement is provided by an adjustable spacer positioned between the confronting spaces of the inner and intermediate ones of the discs in each set. The chamfers on the inner and outer discs face axially inwardly, while the complementary chamfer on the intermediate disc is arranged in the opposite direction.

With such arrangement, adjustment of the warp-free zone between the main and the reinforcing leno weaves can be accomplished merely by adjusting the simple spacer between the inner and intermediate discs, without the necessity of physically substituting different thicknesses of leno discs with the disadvantages outlined above. In addition, the construction of the discs are simplified, since all of the leno discs can be of identical construction except for the sense of chamfering of the intermediate disc. In addition, the corresponding discs on opposite axial ends of the reed shaft are identical.

BRIEF DESCRIPTION OF THE DRAWING

The invention is further set forth in the following detailed description taken in conjunction with the appended drawing, in which.

DETAILED DESCRIPTION

Figure 1:
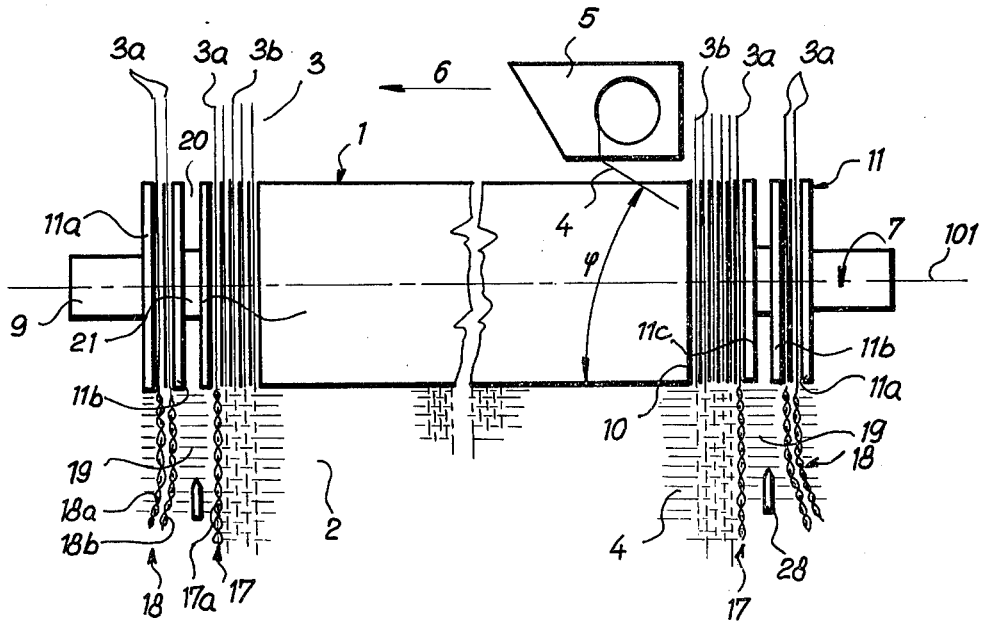
FIG. 1 is an axial view of a ratary reed having an arrangement of end leno beat-up discs constructed in accordance with the invention for providing an adjustable spacing between the main and reinforcing leno weaves of a fabric selvedge.

Referring now to the drawing, FIG. 1 depicts a rotary reed 1 which is supported for rotation, in the direction of an arrow 7, on a reed shaft 9. The reed 1 is adapted to receive successive picks of a weft thread 4 from a weft inserter 5, which in turn is associated with a conventional travelling wave loom. In particular, the inserter 5 is reciprocated, by suitable means not shown, along an axis indicated by an arrow 6 and parallel to an axis of rotation 101 of the rotary reed 1. During each reciprocation, the inserter 5 is passed through a shed of warp threads 3, such shed successively opening in wave-like fashion to receive the inserter 5 during successive portions of its travel.

The warp threads 3 are guided, by suitable heddle frames (not shown) into axially spaced columns along the length of the reed 1, with the threads 3 being subdivided into leno warp threads **3*a* and fabric warp threads 3*b*. The threads 3*b*, which when interwoven with the inserted weft threads 4 and beaten into the fell of a fabric 2 upon rotation of the reed 1 in a conventional manner, form the principal portions of the fabric. The leno threads 3*a*, disposed on axially opposite sides of the threads 3*b*, are interlaced with the same weft threads 4** to define the selvedge areas of the fabric.

The selvedge areas, in turn, are reinforced by a main inner leno weave 17, formed from a single leno element **17*a*, and an auxiliary outer leno weave 18, which is doubled and is formed from a pair of leno elements 18*a* and 18*b*. The portions of the loom that control the conversion of the leno warp elements 3*a* into the final leno weaves 17 and 18 is conventional and will not be described further here. The leno discs merely function to beat-up the weft in the area of the leno selvedge and play no part in the production of the leno selvedge. U.S. Pat. No. 2,399,880, issued May 7, 1946, to A. Moessinger is illustrative of known apparatus including a slotted rotary disc for twisting a pair of leno warp threads, such as the threads 3*a* in FIG. 3 of the instant case, into the twisted arrangement shown herein at 17 and 18 of FIG. 1**.

The reed 1 is formed from a plurality of axially spaced fabric beat-up discs 10, which are secured to a central portion of the shaft 9, with successive ones of the discs 10 guiding the successive columns of fabric warp threads 3 through the reed as shown in FIG. 1. In like manner, the reed 1 further includes two sets of leno discs 11 which are secured to the shaft 9 on axially opposite sides of the fabric discs 10.

Figure 2:
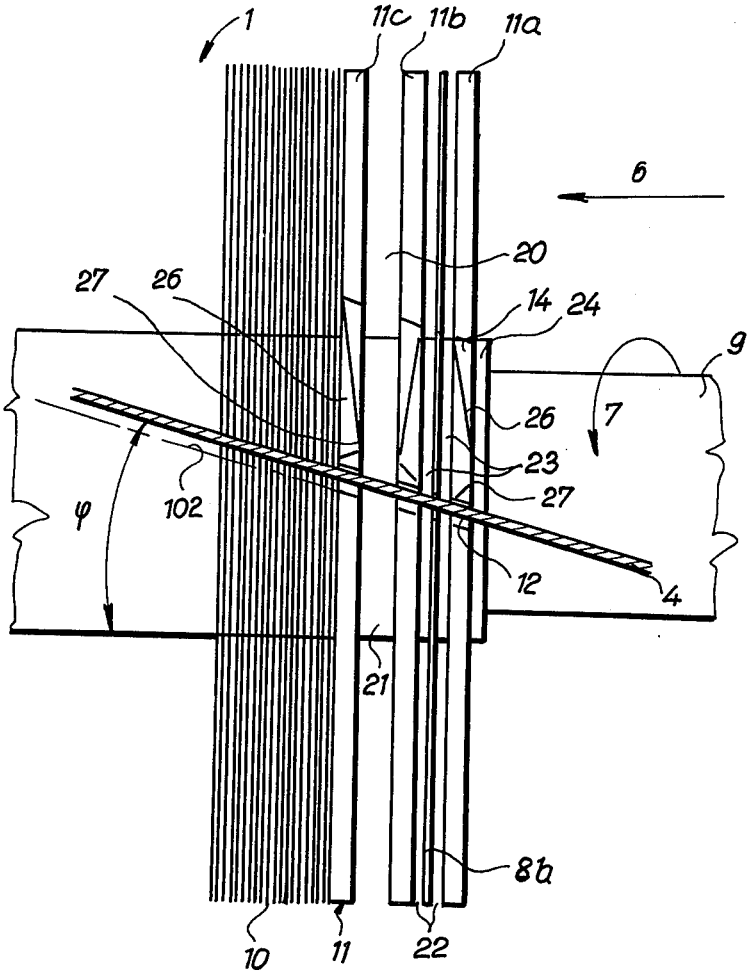
FIG. 2 is an enlarged fragmentary axial view of a portion of the arrangement of FIG. 1, showing details of the arrangement and construction of the leno discs at one end of the rotary reed.

Each of the discs 10 and 11 is provided on its periphery with a plurality of circumferentially spaced weft-receiving cutouts 12, each such cutout forming, with the axis 101 of the reed 1, an angle $\rho$ (FIG. 2). Such angle corresponds to the angle of insertion of a pick of weft thread 4 (FIG. 1) into the reed 1 during a movement of the weft inserter 5. To accomplish this, the weft-receiving cutouts 12 of the successive discs 10, 11 along the length of the reed 1 are circumferentially staggered to form a composite helical channel 102 (FIG. 2). As is well-known, the portion of the weft thread 4 extending into the channel 102 is beaten-up into the fell of the fabric 2 upon a further rotation of the reed 1, during which time the weft in each recess 12 moves out over a beat-up edge 13 (FIG. 3) immediately behind the recess 12.

The main leno weave 17 and the outer auxiliary leno weave 18 are separated by a warp-free area 19, such area 19 being adapted to be severed by a weft cutter 28, whereby the main weave 17 is left to secure the final fabric selvedge.

The warp-free area 19, whose width generally encompasses a plurality of inter-column spacings of the leno warp threads 3*a*, has up to now been comparatively complex and expensive to adjust for different fabric applications. Typically, such zone 19 has been established by the thickness of one of the leno discs 11, whereby changes in the width of the zone 19 had to be accomplished by physically interchanging a pair of leno discs having the same peripheral edge construction but of different thickness corresponding to the change in the area 19.

Figure 3:
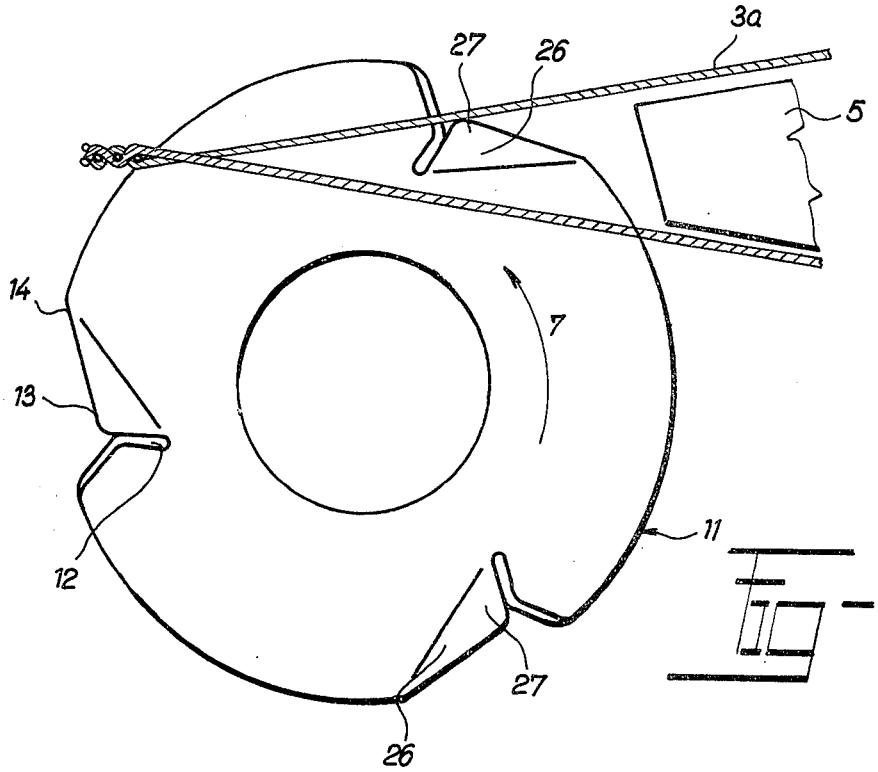
FIG. 3 is an end view of one of the leno discs of FIGS. 1 and 2, illustrating the peripheral edge construction of the disc and the cooperation of a weft-confining chamfer on such edge with an adjacent leno warp thread guided between a pair of the discs.

In accordance with the invention, the warp-free area 19 can be quickly and easily adjusted by arranging the leno discs 11 in the manner shown in FIGS. 1 and 3. Each of the two sets of discs 11 on the opposite sides of the fabric discs 10 includes an outermost disc 11*a*, an intermediate disc 11*b* and an innermost disc 11*c*, with the respective discs 11*a*, 11*b* and 11*c* on opposite sides of the fabric discs 10 being identical. Each of the leno discs, moreover, is made thicker than the fabric discs 10.

The warp-free zone 19 (FIG. 1) is defined between opposed surfaces of the discs 11*b* and 11*c* in each leno set. The inter-disc spacing of such discs, represented at 20, is maintained by a simple spacing element 21 (FIG. 2), which may be adjustable and/or interchangeable with a similar element of different thickness. The spacer 21 is secured to the reed shaft 9 by the action of a releasable collar 24 as indicated below.

In the event that a pair of separate leno elements, such as those indicated at 18*a* and 18*b* of FIG. 1, are employed to form the auxiliary leno weave 18, a spacing 22 between the intermediate and outer discs 11*b* and 11*a* in each leno set is bisected by an auxiliary beat-up disc 8*a*, whose thickness is typically intermediate that of the fabric discs 10 and the main leno discs 11. In such case, the leno warp threads 3*a* forming the elements 18*a* and 18*b* are guided in the adjacent gaps between the disc 8*a* and the discs 11*a* and 11*b*, respectively. In like manner, the leno warp thread 3*a* which is formed into the leno element 17*a* that defines the main leno weave 17 is guided in the gap between the innermost leno disc 11*c* and the adjacent fabric disc 10.

The gaps between the auxiliary disc 8*a* and the adjacent leno discs 11*a* and 11*b* in each set are maintained by a pair of auxiliary spacing rings 23. The collar 24, which abuts the outer surface of the outermost disc 11*a* as shown in FIG. 2, thereby serves to maintain the adjacent and concentric configuration of all of the leno discs and spacers in the associated set.

As shown best in FIG. 3, each of the leno discs 11, in addition to exhibiting the peripheral cutout 12 in common with the fabric discs 10, has a warp-confining chamfer 26 which is disposed adjacent and in trailing relation to each of the recesses 12. Each chamfer has a length corresponding to the entire thickness of the leno disc 11, and converges from a maximum width area, extending from the rear wall of the cutout 12 to a rear edge 14 of the beat-up edge 13, to a minimum-thickness region represented by an edge 27 at the interface of the recess 12 and the beat-up edge 13. The maximum-width portion of each chamfer 26 is disposed adjacent the warp thread 3*a* or 3*b* to be guided thereby, so that even severe misalignments (e.g., up to 30°) in the portion of such warp threads extending through the gaps between adjacent discs can be accommodated without the danger of pass-over of such misaligned thread into the adjacent warp-guiding gap.

Advantageously, the innermost and outermost leno discs 11*a* and 11*c* in each set are of identical construction as seen in FIG. 2. In addition, the intermediate leno disc 11*b* in such set may be of the same overall construction as the discs 11*a* and 11*c*, except that the chamfer 26 thereon is symmetrical to the chamfers on the discs 11*a* and 11*c*. Since a rear surface of the disc 11*c* faces the warp-free zone 20, the opposite surface of such disc 11*c* is arranged so that the maximum-width portion of the chamber 26 faces forwardly to confine the adjacent warp thread, which in such case is the outermost fabric warp thread 3*a* (FIG. 1). In like manner, the maximum-width portion of the chamfer 26 on the outermost disc 11*a* also faces forwardly, thereby to guide and confine the associated leno warp thread 3*a* in the gap between the auxiliary disc 8*a* and the disc 11*a*.

By contrast, the chamfer 26 on the intermediate disc 11*b*, which as indicated before is the mirror image of the chamfers 26 on the discs 11*a* and 11*c*, has its maximum-width portion facing rearwardly, thereby to confine and guide the adjacent leno warp thread 3*a* (FIG. 1) in the gap between the discs 11*b* and 8*a*.

The construction of the leno discs in accordance with the invention is particularly advantageous since not only does the disc thickness remain constant at all times, but in addition the discs are of identical construction, except for the chamfer area 26 in the case of the intermediate disc 11*b*. The resulting interchangeability of discs, together with the use of adjustable or removable spacers to yield a desired width of warp-free zone 19, leads to a much simpler and more economical manipulation of the fabric selvedge than in the prior art.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a rotary reed for a travelling wave loom, the reed comprising a reed shaft, a plurality of first relatively thin discs arranged in axially spaced relation at first intervals on the reed shaft for guiding fabric warp threads therebetween, and means including relatively thick second discs disposed on the reed shaft on respectively opposite sides of the first discs, the peripheries of the successive first and second discs along the reed shaft exhibiting angularly offset recesses which cooperate to establish a substantially helical weft-receiving passage, the improvement wherein first and second sets each including at least three of the second discs are arranged on respectively opposite sides of the first discs for guiding a plurality of leno warp threads, each set of the second discs being arranged to define a warp-free zone therein separating selected ones of the leno warp threads so that said selected threads establish, with an inserted weft, a main inner fabric leno weave and a reinforcing outer leno weave separated by a distance greater than the first interval, and wherein variable spacing means are disposed between and in contact with the opposed surfaces of a predetermined pair of adjacent second discs in each set for establishing the warp-free zone therebetween.

2. Apparatus as defined in claim 1, in which each of the first and second sets of second discs include an innermost disc, an intermediate disc and an outermost disc, the warp-free zone being defined between the innermost and intermediate discs of each set.

3. Apparatus as defined in claim 2, in which the spacing means comprises an exchangeable ring surrounding the reed shaft and interposed between the innermost and intermediate discs in each set, and in which the apparatus further comprises means for releasably urging the innermost and intermediate discs and the interposed ring into intimate engagement.

4. Apparatus as defined in claim 1, in which the corresponding discs in the respective first and second sets are identical.

5. Apparatus as defined in claim 2, in which the innermost and outermost discs of each set are identical.

6. Apparatus as defined in claim 5, in which each second disc exhibits a peripheral weft-confining chamfer adjacent the corresponding peripheral recess.

7. Apparatus as defined in claim 6, in which the peripheral chamfer on the intermediate disc is symmetrical to the chamfers on the innermost and outermost discs.

8. Apparatus as defined in claim 7, in which the innermost and outermost discs are supported on the reed shaft with their respective peripheral chamfers extending in the same axial direction, and in which the intermediate disc of such set is supported on the reed shaft with its peripheral recess in confronting relation to the recess of the outermost disc.

9. Apparatus as defined in claim 1, in which the length of the chamfer extends through the entire thickness of the associated second disc.

10. Apparatus as defined in claim 1, in which each second disc is thicker than each first disc.

11. Apparatus as defined in claim 10, in which the apparatus further comprises an auxiliary disc supported on the reed shaft between and in spaced relation to the intermediate and outermost disc in each set.

12. Apparatus as defined in claim 11, in which the thickness of the auxiliary disc is intermediate that of the first and second discs.

* * * * *